United States Patent [19]

Linton

[11] Patent Number: 4,593,509

[45] Date of Patent: Jun. 10, 1986

[54] BUILDING STRUCTURE

[75] Inventor: Derek Linton, Paddock Wood, England

[73] Assignee: Linton Systems Limited, Marlow, England

[21] Appl. No.: 461,274

[22] Filed: Jan. 26, 1983

[30] Foreign Application Priority Data

Oct. 7, 1982 [GB] United Kingdom ..... 8228660

[51] Int. Cl.[4] ..... E04B 1/00

[52] U.S. Cl. ..... 52/262; 52/90; 52/22; 52/350

[58] Field of Search ..... 52/309.7, 309.16, 348, 52/350, 601, 664, 666, 290, 309.11, 90, 262, 22

[56] References Cited

U.S. PATENT DOCUMENTS

| | | | |
|---|---|---|---|
| 1,674,096 | 6/1928 | Collins | 52/350 |
| 1,786,751 | 12/1930 | Heeren | 52/350 |
| 2,058,386 | 10/1936 | Parsons | 52/290 |
| 3,477,187 | 11/1969 | Fruman | 52/346 |

FOREIGN PATENT DOCUMENTS

| | | | |
|---|---|---|---|
| 910725 | 6/1946 | France | 52/601 |
| 1138751 | 6/1955 | France | 52/262 |
| WO82/03236 | 9/1982 | PCT Int'l Appl. . | |
| 972383 | 10/1964 | United Kingdom | 52/664 |
| 1080883 | 8/1967 | United Kingdom . | |
| 1088460 | 10/1967 | United Kingdom . | |
| 1147772 | 4/1969 | United Kingdom . | |
| 1175711 | 12/1969 | United Kingdom . | |
| 1310023 | 3/1973 | United Kingdom . | |

*Primary Examiner*—Carl D. Friedman
*Assistant Examiner*—Naoko N. Slack
*Attorney, Agent, or Firm*—Klarquist, Sparkman, Campbell, Leigh & Whinston

[57] ABSTRACT

A ceiling/floor or ceiling/roof structure comprising a plurality of substantially parallel substantially horizontally extending joists, each joist being supported at the two opposed ends thereof, a first set of transverse members resting on the top of and secured to the top of at least some of said joists, and a further set of transverse members extending underneath and connected to the lower surfaces of at least some of said joists, the said structure being adapted to be associated with ceiling and/or roofing or flooring materials.

12 Claims, 11 Drawing Figures

16
17
8
24
22
31
22
32
22
30

BUILDING STRUCTURE

BACKGROUND OF THE INVENTION

The present invention relates to a building structure and more particularly relates to part of a building structure that constitutes a ceiling/floor or a ceiling/roof assembly.

The present invention will be described with reference to a method of building that utilises pre-formed components that can be rapidly assembled together, an inter-space defined by the assembled components being filled with a foam material. However it is to be appreciated that the invention is not restricted to such a specific use.

BRIEF SUMMARY OF THE INVENTION

According to this invention there is provided a ceiling/floor or ceiling/roof structure comprising a plurality of substantially parallel substantially horizontally extending joists, each joist being supported at the two opposed ends thereof, a first set of transverse members resting on the top of and secured to the top of at least some of said joists, and a further set of transverse members extending underneath and connected to the lower surfaces of at least some of said joists, the said structure being adapted to be associated with ceiling and/or roofing or flooring materials.

In one embodiment all the joists lie in a common plane and said first set of transverse members and said further set of transverse members all contact all of the joists and are secured thereto.

In an alternative at least some of the joists are inclined upwardly relative to the remaining joists so that the inclined joists extend above said remaining joists, said first set of transverse members being connected to the upper surfaces of the said inclined joists and said lower set of transverse members being connected to the undersides of the remaining joists.

Preferably each joist comprises two substantially "c" sectioned channel members made of metal and mounted back-to-back.

Conveniently the abutting portions of said channel members are apertured to minimise the weight of the joists.

Advantageously each said transverse member comprises a member of substantially "top hat" cross section thus comprising two substantially horizontal flanges having free edges, and a central raised portion connected by two substantially vertical or sloping portions with the other edges of said flanges.

Preferably the said two flanges of each transverse member are connected to the upper or lower surfaces of the relevant joists.

In one embodiment said joists are supported by channel members extending transversely to the ends of the joists.

Preferably the space or at least part of the space between the joists is filled with a thermally insulating foam material.

Conveniently said foam is a substantially rigid foam which improves the load bearing properties of the ceiling/roof or ceiling/floor structure.

INTRODUCTION TO THE DRAWINGS

In order that the invention may be more readily understood, and so that further features thereof may be appreciated, the invention will now be described, by way of example, with reference to the accompanying drawings in which.

DESCRIPTION OF PREFERRED EMBODIMENTS

Figure 1:
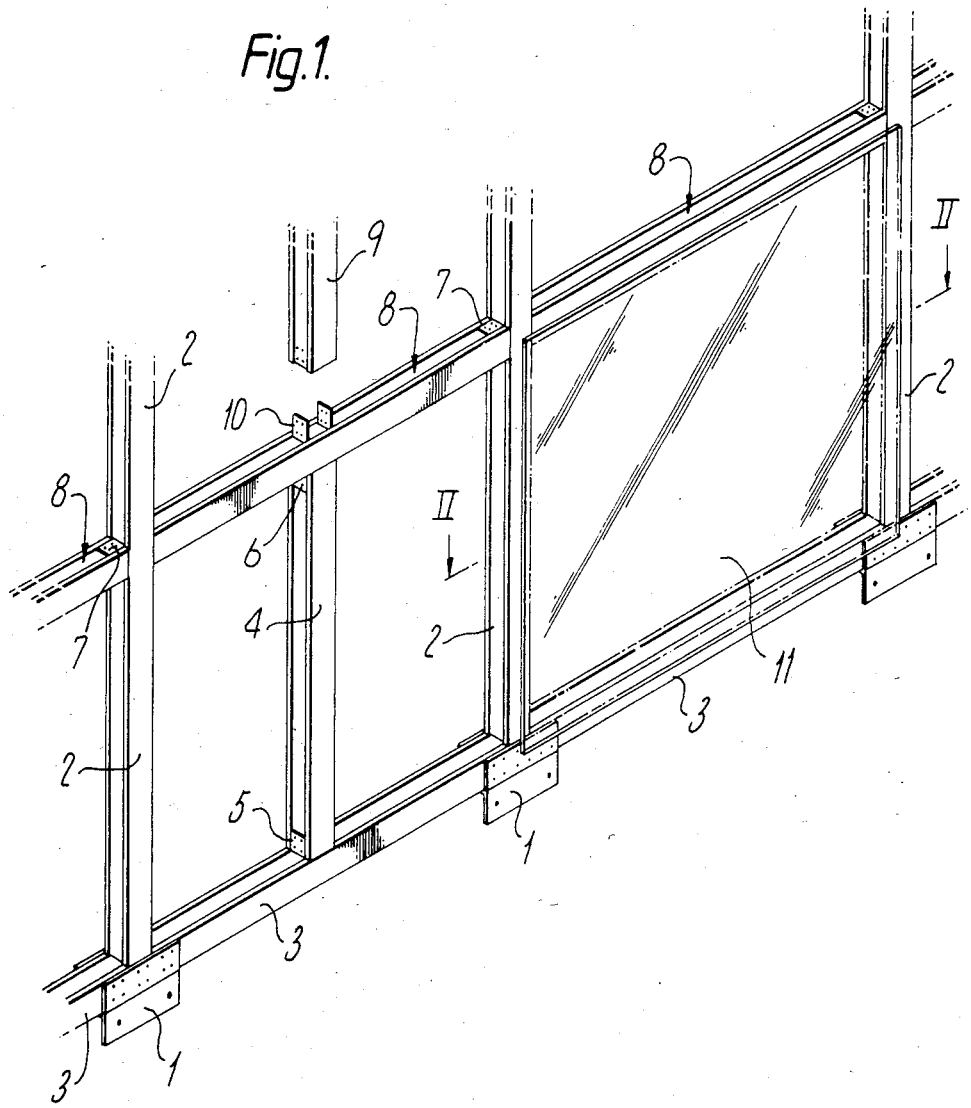
FIG. 1 is a perspective view of part of a building, whilst under construction.

Referring initially to FIG. 1 a wall of a building is illustrated. The wall is effectively secured to a concrete raft (not shown) by means of a fastening bracket 1. Vertical members 2 are connected to the brackets 1, and horizontal members 3 are also connected between the adjacent backets 1. Further vertical members 4 are connected to the horizontal members 3 by means of brackets 5. The brackets 5 are each of "U" configuration, the flat base of the "U" being secured to the horizontal member 3, and the two upstanding arms of the "U" embracing the lowermost portion of each vertical member 4. A similar, but inverted, bracket 6 is provided at the top of the vertical member 4. Brackets 7, corresponding to the brackets 5, are utilised to connect further horizontal members 8 to the upright members 2 at positions spaced above the horizontal members 3. The brackets 6 provided at the upper end of the vertical member 4 serve to interconnect that vertical member 4 to the appropriate horizontal member 8.

A further vertical member 9 can be connected to the horizontal member 8 by means of a further brackets 10 which corresponds with the brackets 5 described below.

It will thus be appreciated that a framework can be created, and the framework will effectively define the outer walls of the building.

Figure 2:
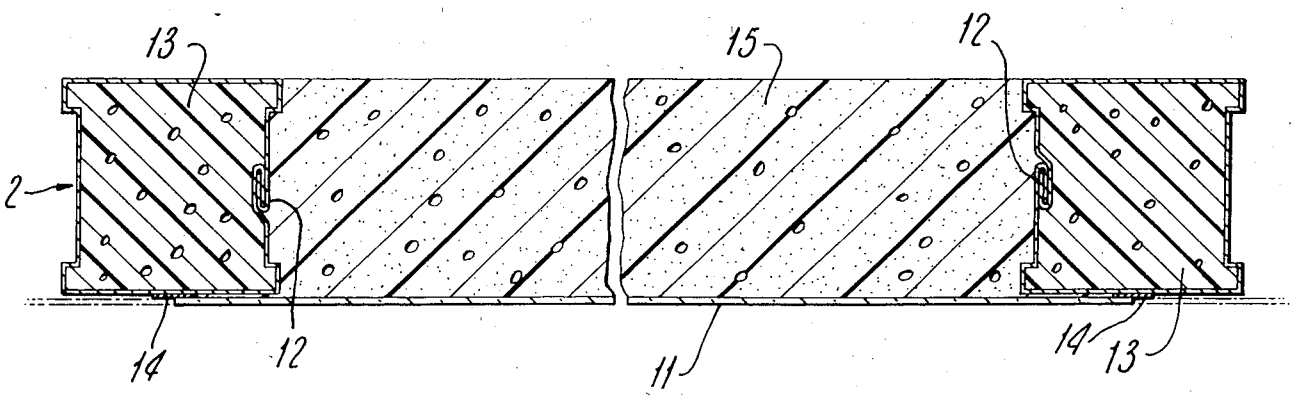
FIG. 2 is a sectional view taken on the line II—II of FIG. 1.

As can be seen most clearly from FIG. 2 each of the upright members 2 is formed as a hollow cold rolled lock seamed tube formed from hot dipped galvanised mild steel or stainless steel, or aluminum. Each tube is of substantially square cross section, but two elongate recesses are formed in two opposed faces of the tube so that the tube is of generally "H" cross section and the lock seam 12 is located in the base of one of these recesses. The tube is entirely filled with a substantially rigid foamed plastics material 13 which may be a polyurethane foam or any other appropriate foam. A tube of this construction may be fabricated from relatively thin galvanised mild steel or stainless steel, or aluminium but will have substantial strength and will also have excellent thermal insulation properties by virtue of the foam filling for the tube.

One surface of each wall of the complete framework is provided with a sheet 11 of appropriate material, and it is most preferred that the sheet is of translucent polyethene, and may be a cross laminate of oriented high density polythene as sold under the Trade Mark "VALERON" by Van Leer (U.K.) Limited of Ellesmere Port, Livepool, or a spunbonded polyolefin sheet, such as sold under the Registered Trade Mark "TYVEK", especially grade 1043B by Wiggins Teape Synthetics of Basingstoke, Hampshire. The sheet is secured in position to extend across all the apertures defined by the framework, and is preferably located on the exterior of the framework so that the sheet then defines the outermost surface of the structure. The sheet may be held in position by means of double sided adhesive tape 14 utilised to secure the sheet to the vertical members 2 and the horizontal members 3 and 8.

A sprayed foam material, such as sprayed polyurethane foam or sprayed polyisocyanurate foam may then be sprayed, from the interior of the framework, on to the polythene sheet. An initial thin spray of foam is applied which, as a result of the heat generated during the foaming process, bonds firmly to the polythene sheet and rapidly cures or solidifies. One or more subsequent layers of foam can be provided until the entire inter-space defined by the frame members and the polythene sheet is filled with foam material 15, apart from those regions of the framework that are intended to define apertures to accommodate doors or windows. The inner surface of the foam 15 is made flush with the inner surfaces of the various frame members. Internal cladding, such as conventional dry lining, can be mounted in position on the interior of the walls and an appropriate external cladding can be provided.

The insulating foam utilised may be any convenient foam, but reference may be made to a polyurethane foam, the components of which are sold under the Trade Mark Trade Mark "ISOFOAM" by the Baxendon Chemical Company Limited of Accrington, Lancashire. The foam is created by mixing an isocyanate and a polyol. Grade SS212 may be found suitable for spraying and grade RM114 may be found suitable for injection into the hollow box sections constituting the frame members. Such a foam may easily be treated to have good fire resistance properties. Another suitable foam is that known as the Coolag Toucan System CSS 732 which is a two component polyethylene spray foam system, in which one component is a resin blend containing polyol, catalysts, a fire retardant and a blowing agent and the other component is a polymeric isocyanate. The components for making this foam are sold by Coolag Limited of Charlestown, Glossop, Derbyshire. However, alternatively, phenolic resin based foams may be used which may have extremely good, class O, fire resistance properties.

It is to be noted that the lock seams 10 of the various members forming the framework are so located that when the foam material 15 has been sprayed onto the polythene sheet 11 the foam material covers the lock seam 12, thus minimising any risk of corrosion commencing at this point.

Figure 3:
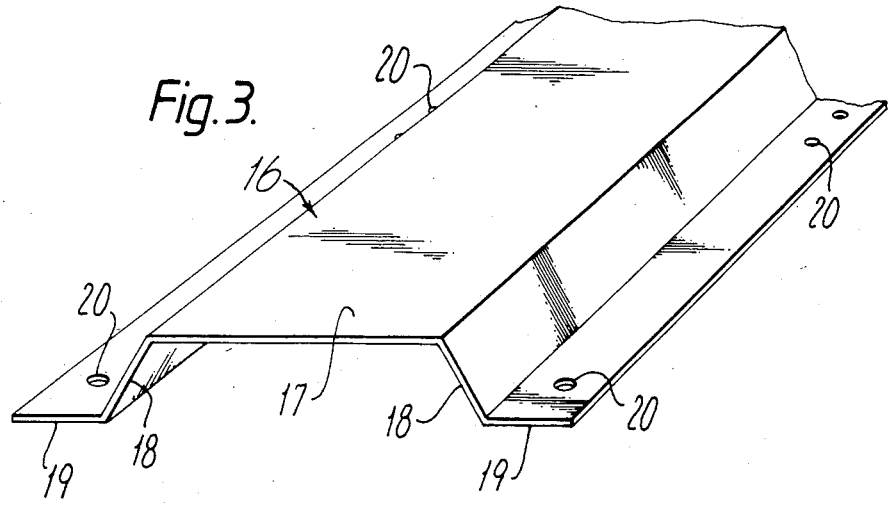
FIG. 3 is a perspective view of part of an elongate member utilised in forming the described structure.

FIG. 3 illustrates an elongate metallic member that forms part of the ceiling/floor structure to be described. The elongate member 16 is of "top hat" cross-section. The member has a central elevated planar portion 17 joined by two downwardly inclined connecting portions 18 with two outwardly directed horizontal flanges 19, these flanges being parallel with the planar portion 17 but spaced therefrom. Connecting holes 20 are formed in the flanges 19 at the desired locations. These connecting holes are dimensioned to accommodate rivets, as will be described hereinafter.

Figure 4:
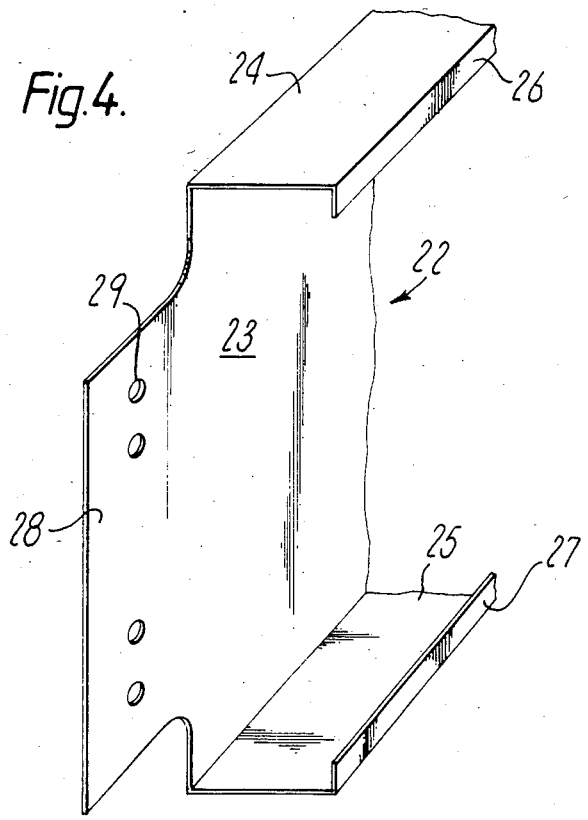
FIG. 4 is a corresponding view of part of another elongate member utilised in forming the structure.

FIG. 4 illustrates another elongate member 22 that forms part of the structure to be described. This elongate member comprises a substantially "C" section channel member having a primary vertical wall 23 carrying, at its top and bottom side edges inwardly directed upper and lower horizontal flanges 24, 25. These flanges terminate respectively in downwardly and upwardly inclined lips 26, 27. The vertical wall 23 is extended at one end of the element to form a protruding tongue 28. This tongue is provided with connection apertures 29. Appropriate apertures, not shown, are provided at desired locations along the length of the elongate member 22 both in the vertical wall 23 and in the two horizontal flanges 24, 25.

Figure 5:
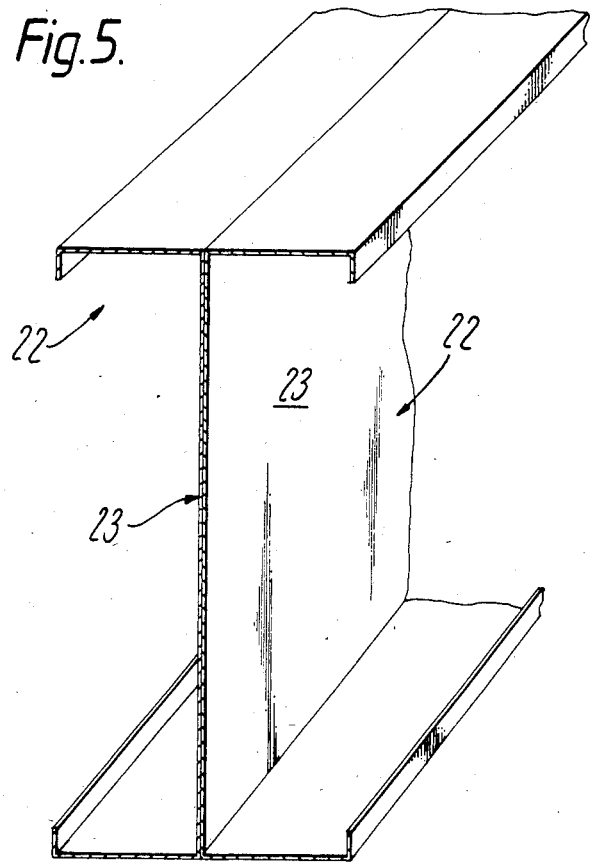
FIG. 5 is a corresponding view of part of an assembly of two elongate members as shown in FIG. 4.

FIG. 5 shows two elongate elements 22 as shown in FIG. 4 mounted back-to-back, with the vertical walls 23 of the two members abutting. The elongate members are interconnected by means of rivets passing through aligned holes (not shown) in the abutting vertical walls 23.

Figure 6:
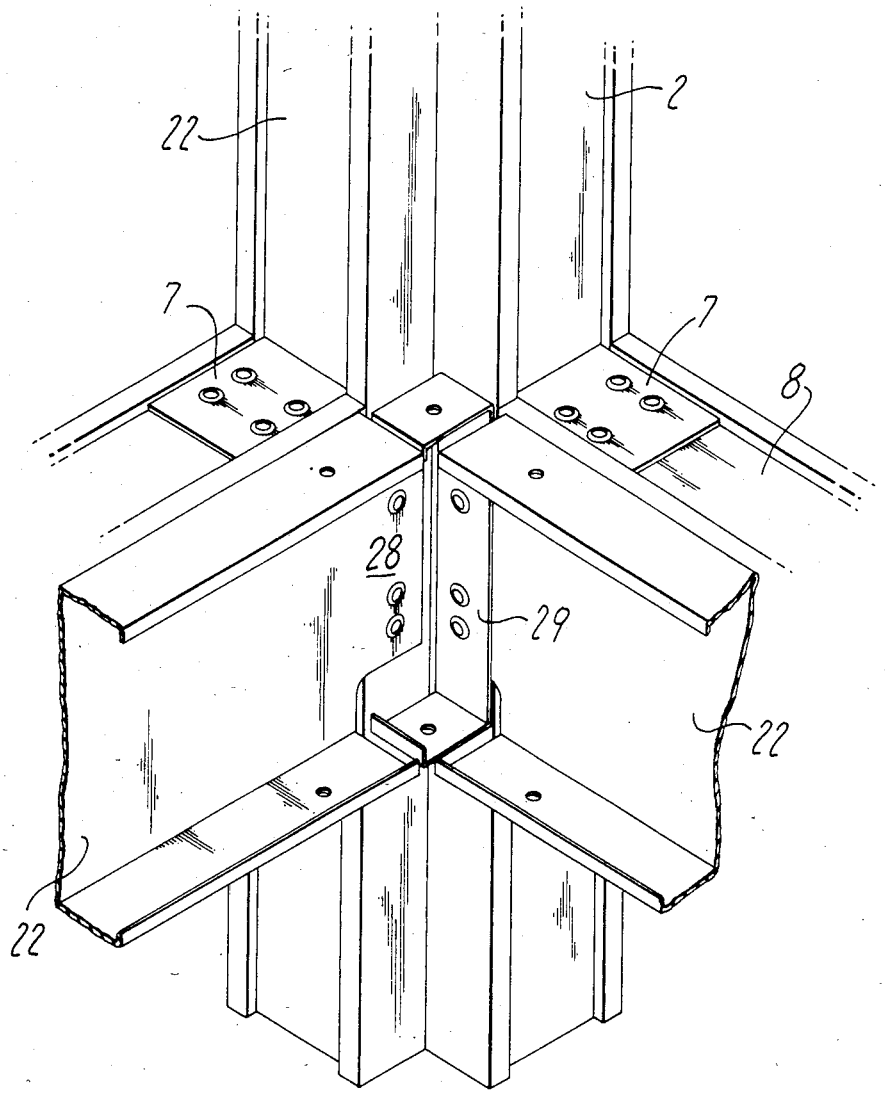
FIG. 6 illustrates the junction between the supports for the described ceiling/floor assembly at one corner of a building.

Turning now to FIG. 6, the interconnection between vertical members 2 and horizontal members 8 as described above with reference to FIG. 1 can be seen, and part of the brackets 7 are visible. It will be noted that elongate members 22 are connected to the horizontal members 8 by means of appropriate rivets (not shown), and also the protruding tongues 28 of these members are connected to the vertical members 2 by means of appropriate rivets. A small infill member 29 is provided which comprises merely a short section of a channel member having the same configuration as the elongate member 22, but not having the end tongues. This infill portion 29 is mounted in position by means of the rivets that pass through the tongue the co-aligned channel member 22.

It will be appreciated that similar constructions will be provided at the four corners of an area that is to be supplied with a ceiling/floor assembly.

Figure 7:
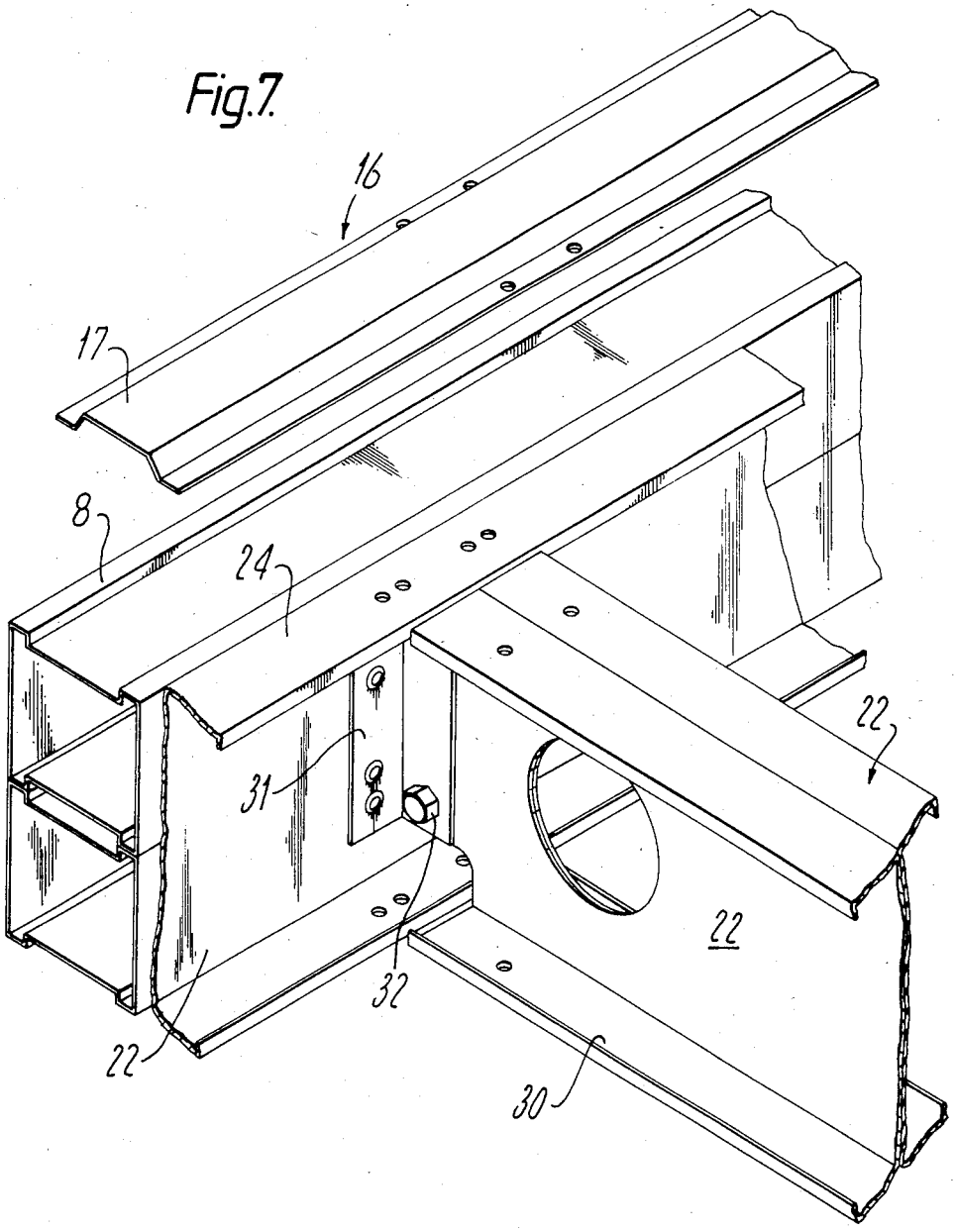
FIG. 7 illustrates a connection between a horizontal member and a support joist forming part of the described ceiling/floor assembly.

A plurality of joists are then mounted in position, as can be seen most clearly in FIG. 7. The joists all extend in a parallel manner across the space where the ceiling/floor assembly is to be provided. Each joist 30 is constituted by an assembly of two elongate members 22, mounted back-to-back. The protruding tongues provided at the ends of the members extend into the space defined by the channel member 22 that is connected to the horizontal member 8. At this point it is to be noted that the horizontal member 8 is effectively formed by the combination of two members for additional strength. The joist 30 is held in position in the channel 22 by means of two "L" shaped brackets 31, each of the said brackets having one arm thereof rivetted to the channel member 22 and thus also to the horizontal member 8, the other arm of the "bracket" being bolted to the protruding tongue 28 provided at the end of the joist 30 by means of an appropriate bolt or rivet 32.

A portion of the elongate member 16 is then rivetted into position on top of the uppermost flange 24 of the channel member 22 secured to the horizontal member 8, and resting on the uppermost flange of the joist 30.

Appropriate apertures are formed in the flanges to receive rivets or the like.

Figure 8:
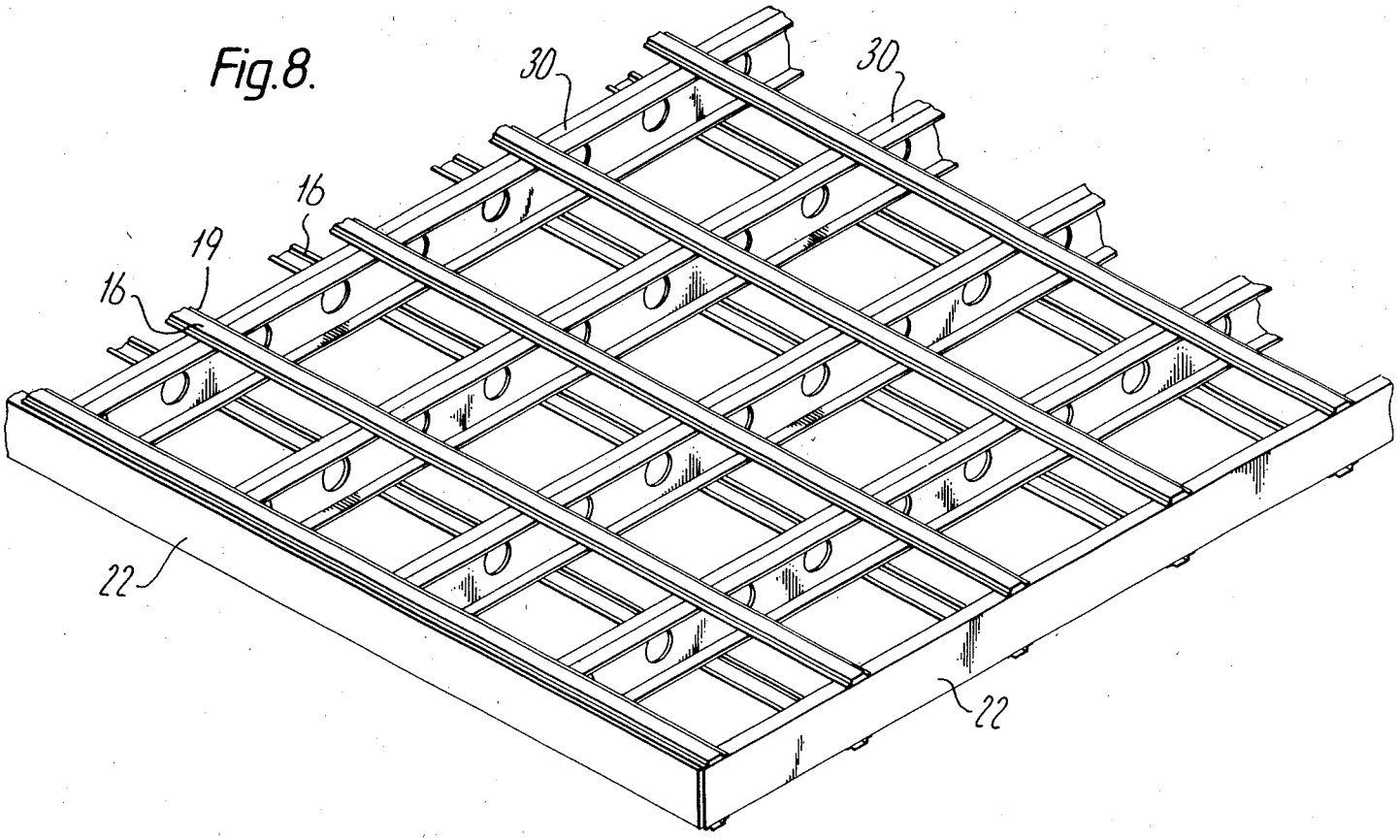
FIG. 8 is a perspective view of part of a completed ceiling/floor assembly.

FIG. 8 illustrates merely the ceiling/floor assembly that is presently being described, and thus illustrates the outer peripheral channel members 22, but does not illustrate the horizontal members 8 that are actually supporting the channel members 22. This is for clarity of illustration, but it is to be appreciated that the illustrated channel members 22 would always be supported by appropriate horizontal members before the floor assembly could be created.

As can be seen in FIG. 8 a plurality of horizontal joists 30 have been mounted in position. Extending transversely of the joists 30 are a plurality of parallel elongate transverse members 16, these members being located on top of the joists with the flanges 19 thereof in contact with the joists. The elongate transverse members 16 are connected to the joists at the points of contact by appropriate rivets. Further elongate transverse members 16 extend, in alignment with the member 16 on top of the joists, on the undersides of the joists. Again the flanges 19 of the elongate member 16 are in contact with the joists and are connected thereto by means of rivets.

The resultant floor structure is extremely strong, even though it is made with relatively light weight components. Also the floor is able to withstand a very high floor loading at any selected point, since the load will rapidly be spread by the described structure and will thus be absorbed by a number of joists.

When the structure has been completed either flooring or ceiling material may be mounted in position on either the top or the bottom of the structure, and the interspace between the joists may then be filled or at least partly filled with foam, in a manner as described above.

Figure 9:
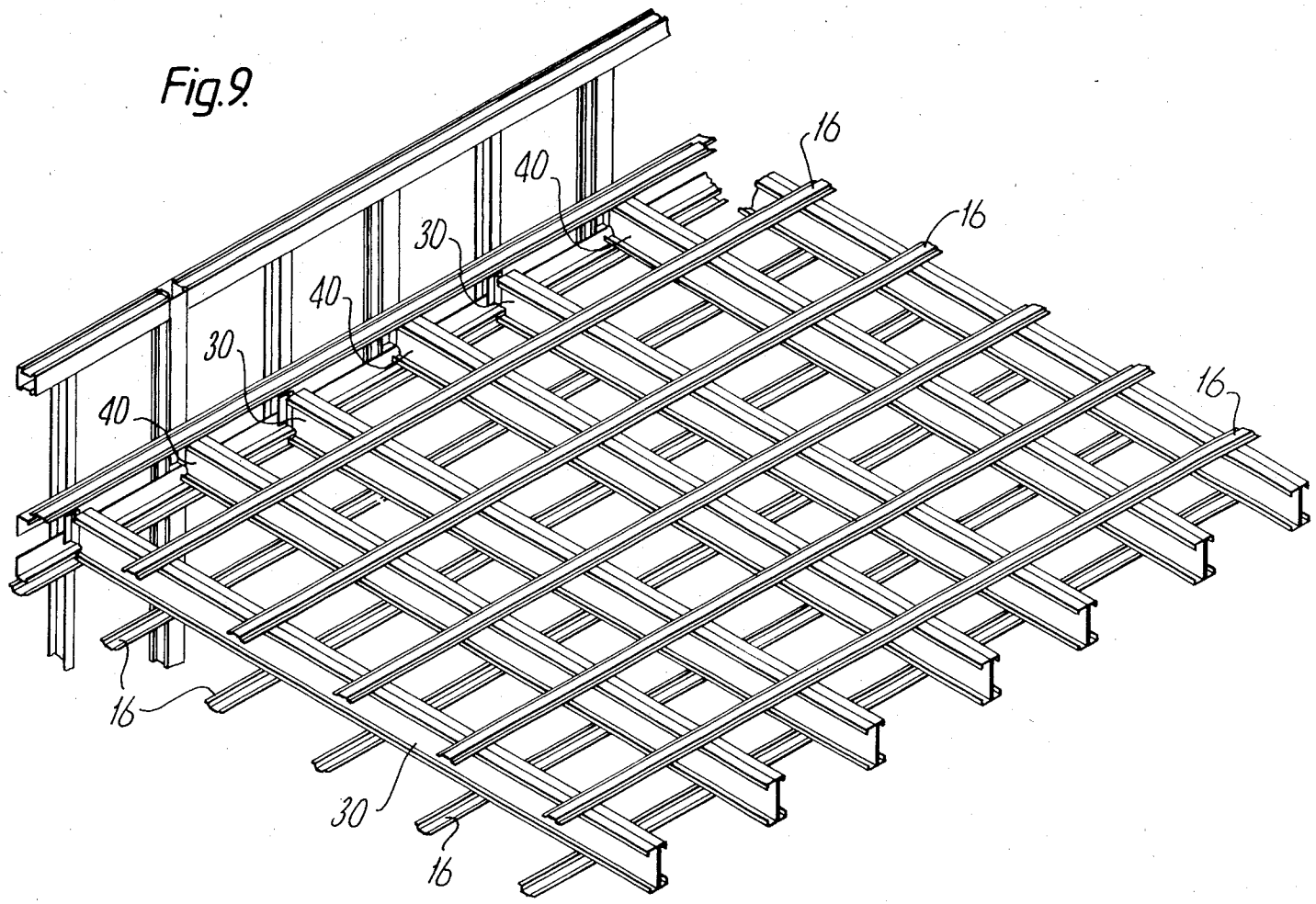
FIG. 9 is a perspective view of part of a ceiling/roof assembly providing a sloping flat roof.
Figure 10A:
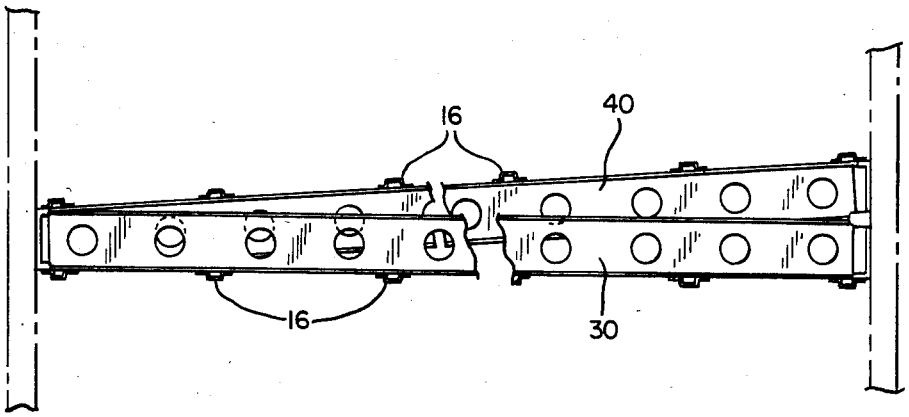
FIG. 10A is a horizontal section view taken along the line 10A—10A of FIG. 10.
Figure 10:
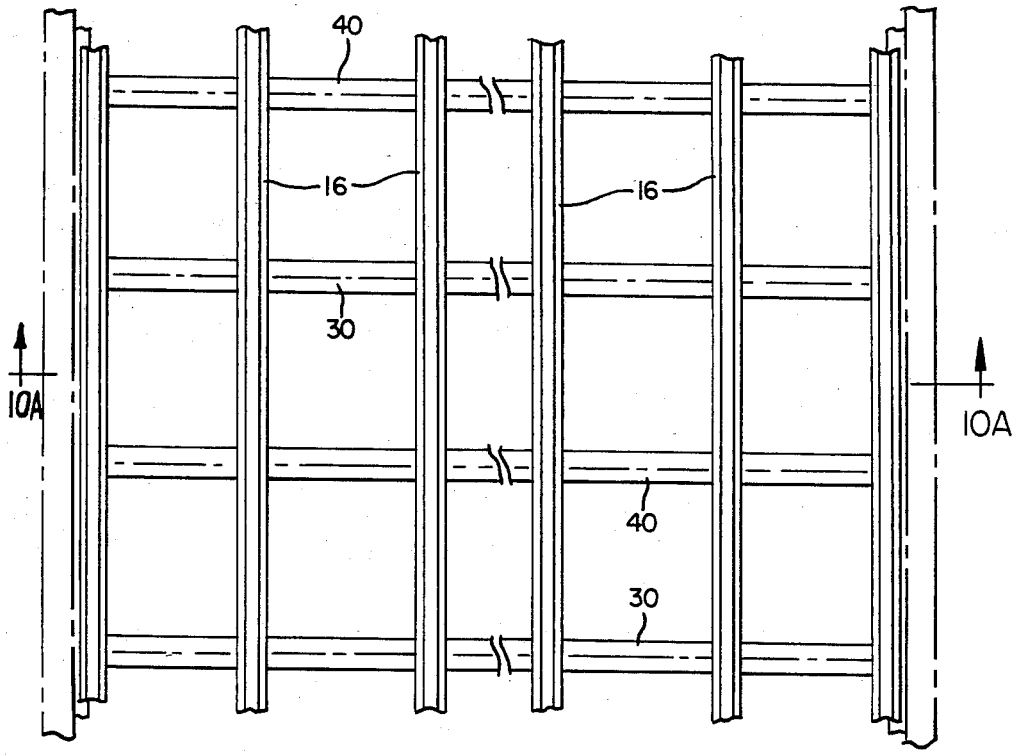
FIG. 10 is a plan view of the ceiling/roof assembly of FIG. 9.

FIG. 9 illustrates a ceiling/roof assembly. It can be seen that the illustrated arrangement is very similar to the arrangement illustrated in FIG. 8. A plurality of horizontal joists 30 are provided, and elongate transverse members 16 are secured to the underside of these joists. Interposed between the joists 30 are a plurality of inclined joists 40 which are inclined upward relative to and extend above the horizontal joists 30, and elongate transverse members 16 are connected to the tops of these inclined joists. Thus the elongate members 16 on the undersides of the horizontal joists can be utilised to support a flat ceiling, whereas the elongate members 16 on top of the sloping joists 40 can be utilised to support a sloping roof. It will be appreciated that the precise configuration of the horizontal member supporting the ends of the joists is modified to enable the ends of the joists 30 and 40 to be spaced apart in a vertical sense. Again it is to be appreciated that the interspace between the joists may be filled with a suitable foam material.

What is claimed is:

1. A joist assembly structure comprising a plurality of substantially parallel horizontally spaced joists each having two opposed ends, an upper surface and a lower surface, each joist being supported at the two opposed ends thereof, at least some of said joists being inclined upwardly relative to the remaining joists which are substantially horizontal so that the inclined joists extend above said remaining joists, a first set of transverse members resting on top of and secured to the top of the upper surfaces of said inclined joists, and a further set of transverse members extending underneath and connected to the lower surfaces of said remaining joists, the said structure being adapted to be attached to ceiling or roofing materials supported on said transverse members.

2. A structure according to claim 1 wherein each joist comprises two substantially "c" sectioned channel members made of metal and mounted back-to-back.

3. A structure according to claim 2 wherein the abutting portions of said channel members are apertured to minimise the weight of the joists.

4. A structure according to claim 1 wherein each said transverse member comprises a member of substantially "top hat" cross section thus comprising two substantially horizontal flanges having free edges, and a central raised portion connected by two substantially vertical or sloping portions with the other edges of said flanges.

5. A structure according to claim 4 wherein the said two flanges of each transverse member are connected to the upper or lower surfaces of the relevant joists.

6. A structure according to claim 1 wherein said joists are supported by channel members extending transversely to the ends of the joists.

7. A structure according to claim 1 wherein at least part of the space between the joists is filled with a thermally insulating foam material.

8. A structure according to claim 7 wherein said foam is a substantially rigid foam which improves the load bearing properties of the ceiling/roof or ceiling/floor structure.

9. A ceiling or roof structure comprising a plurality of substantially parallel horizontally spaced joists, each joist being supported at two opposed ends, and having an upper surface and a lower surface, a first set of transverse members resting on top of and secured to the top of at least some of said joists, and a further set of transverse members extending underneath and connected to the lower surfaces of at least some of said joists, some of the joists being inclined upwardly relative to the remaining joists so that said inclined joists extend above said remaining joists, said first set of transverse members being connected to the upper surfaces of the said inclined joists, and said further set of transverse members being connected to the lower surfaces of the remaining joists, each transverse member comprising a member of substantially top hat cross-section, thus comprising two substantially horizontal flanges having free edges and a central raised portion connected by two further portions with the other edges of said flanges, said flanges of each transverse member being secured to said joists with the central raised position being spaced away from the joists, and the said structure being adapted to be attached to ceiling or roof forming materials.

10. A structure according to claim 9 which constitutes a ceiling/floor structure where all the joists lie in a common plane and said first set of transverse members and said further set of transverse members all contact all of the joists and are secured thereto.

11. A structure according to claim 9 wherein the central raised portion of each said transverse member is connected with the other edges of the flanges by substantially vertical portions.

12. A structure according to claim 9 wherein the central raised portion of each said transverse member is connected with the other edges of said flanges by means of sloping portions.

* * * * *

UNITED STATES PATENT AND TRADEMARK OFFICE

CERTIFICATE OF CORRECTION

PATENT NO. : 4,593,509

DATED : June 10, 1986

INVENTOR(S) : DEREK LINTON

It is certified that error appears in the above-identified patent and that said Letters Patent is hereby corrected as shown below:

In the Specification:

Column 2, line 36, "backets" should be --brackets--.

Column 2, line 60, "aluminum" should be --aluminium--.

Column 3, line 7, "polyethene" should be --polythene--.

Column 3, line 42, "Trade Mark Trade Mark" should be --Trade Mark--.

Column 4, line 42, after "tongue" insert --of--.

Signed and Sealed this

Thirty-first Day of March, 1987

*Attest:*

DONALD J. QUIGG

*Attesting Officer*

*Commissioner of Patents and Trademarks*